US011722819B2

(12) United States Patent
Malik et al.

(10) Patent No.: US 11,722,819 B2
(45) Date of Patent: Aug. 8, 2023

(54) ADAPTIVE FEEDBACK CANCELATION AND ENTRAINMENT MITIGATION

(71) Applicant: META PLATFORMS TECHNOLOGIES, LLC, Menlo Park, CA (US)

(72) Inventors: Sarmad Aziz Malik, Redmond, WA (US); Nils Thomas Fritiof Lunner, Redmond, WA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 14 days.

(21) Appl. No.: 17/481,170

(22) Filed: Sep. 21, 2021

(65) Prior Publication Data

US 2023/0090315 A1 Mar. 23, 2023

(51) Int. Cl.
*H04R 3/00* (2006.01)
*H04R 3/02* (2006.01)
*H04R 1/02* (2006.01)

(52) U.S. Cl.
CPC ..... *H04R 3/02* (2013.01); *H04R 1/025* (2013.01)

(58) Field of Classification Search
CPC ..... H04R 3/00; H04R 3/002; H04R 3/005; H04R 3/02; H04R 3/04; H04R 1/025; H04R 1/1083; H04R 25/45; H04R 25/453; H04R 2430/03; G10K 11/175; G10K 11/178; G10K 11/1781; G10K 11/17815; G10K 11/17817; G10K 11/17819; G10K 11/1785; G10K 11/17853; G10K 11/17854; G10K 11/17879; G10K 11/17881; G10L 21/02
See application file for complete search history.

(56) References Cited

U.S. PATENT DOCUMENTS

2003/0053647 A1* 3/2003 Kates ..... H04R 3/002 381/318
2010/0020979 A1* 1/2010 Elmedyb ..... H04R 25/453 381/60
2011/0007907 A1* 1/2011 Park ..... G10K 11/17855 381/71.8
2011/0026724 A1* 2/2011 Doclo ..... G10K 11/17854 381/71.8
2011/0150257 A1* 6/2011 Jensen ..... H04R 25/453 381/318
2011/0188686 A1* 8/2011 Munk ..... H04R 25/453 381/318
2014/0355802 A1* 12/2014 Elmedyb ..... H04R 3/002 381/318
2021/0014593 A1* 1/2021 Araki ..... H04R 3/02

* cited by examiner

*Primary Examiner* — Thang V Tran
(74) *Attorney, Agent, or Firm* — Fenwick & West LLP

(57) ABSTRACT

An audio system for artificial reality systems is configured to reduce feedback and mitigate entrainment in audio content presented to the user. The audio system utilizes adaptive feedback cancellation processes to reduce feedback. The audio system processes reference signals in a hybrid of the time domain and the frequency domain to achieve rapid convergence with decreased entrainment. The audio system may pre-whiten reference signals and speaker signals and separate the pre-whitened signals into frequency bands using a filter bank. The audio system uses a state space algorithm to generate adaptive filters in each frequency band. The adaptive filters may be applied to the speaker signal to generate a feedback cancelation signal which may be subtracted from the reference signal to decrease feedback.

17 Claims, 9 Drawing Sheets

ADAPTIVE FEEDBACK CANCELATION AND ENTRAINMENT MITIGATION

FIELD OF THE INVENTION

This disclosure relates generally to audio signal processing, and more specifically to adaptive feedback cancellation and entrainment mitigation.

BACKGROUND

Audio systems often include a microphone configured to detect sounds in a local environment, and a speaker configured to provide sounds to the wearer of the headset. However, the microphone may detect a portion of the sounds emitted by the speaker. The detection of sounds emitted by the speaker may result in feedback, which may manifest as a loud squeal or other undesirable noise. The feedback may increase rapidly in response to a change in condition, such as in response to a headset wearer placing their hand near their ear. Additionally, when a user wears a headset that includes speakers positioned within the ear canal of the user's ears, the user's own voice can sound to the user to have a boominess property which is undesirable to the user.

SUMMARY

An audio system is configured to reduce feedback and mitigate entrainment in audio content presented to the user. The audio system may be part of an artificial reality system. The audio system utilizes adaptive feedback cancellation processes to reduce feedback. The audio system processes reference signals in a hybrid of the time domain and the frequency domain to achieve rapid convergence with decreased entrainment. The audio system may pre-whiten reference signals and speaker signals and separate the pre-whitened signals into frequency bands using a filter bank. The audio system uses a state space algorithm to generate adaptive filters in each frequency band. The adaptive filters may be applied to the speaker signal to generate a feedback cancelation signal which may be subtracted from the reference signal to decrease feedback.

In some embodiments, an audio system may generate, based on a reference audio signal received by the reference microphone, a reference signal. The audio system may reduce feedback in a speaker signal provided to the speaker by feedforward processing the reference signal. The audio system may mitigate entrainment in the speaker signal by processing an error signal and the speaker signal in the frequency domain using state space filtering. The audio system may update the error signal by subtracting, based on the state space filtering, a feedback cancelation signal from an updated reference signal. The audio system may generate an updated speaker signal by feedforward processing the updated error signal.

In some embodiments, a method may comprise generating, based on a reference audio signal received by a reference microphone, a reference signal. The method may comprise reducing feedback in a speaker signal provided to the speaker by feedforward processing the reference signal. The method may comprise mitigating entrainment in the speaker signal by processing an error signal and the speaker signal in the frequency domain using state space filtering. The method may comprise updating the error signal by subtracting, based on the state space filtering, a feedback cancelation signal from an updated reference signal. The method may comprise generating an updated speaker signal by feedforward processing the updated error signal.

In some embodiments, a non-transitory computer-readable storage medium may comprise stored program code that, when executed by one or more processors of an audio system, causes the audio system to generate, based on a reference audio signal received by the reference microphone, a reference signal. The program code may cause the audio system to reduce feedback in a speaker signal provided to the speaker by feedforward processing the reference signal. The program code may cause the audio system to mitigate entrainment in the speaker signal by processing an error signal and the speaker signal in the frequency domain using state space filtering. The program code may cause the audio system to update the error signal by subtracting, based on the state space filtering, a feedback cancelation signal from an updated reference signal. The program code may cause the audio system to generate an updated speaker signal by feedforward processing the updated error signal.

Figure 1A:
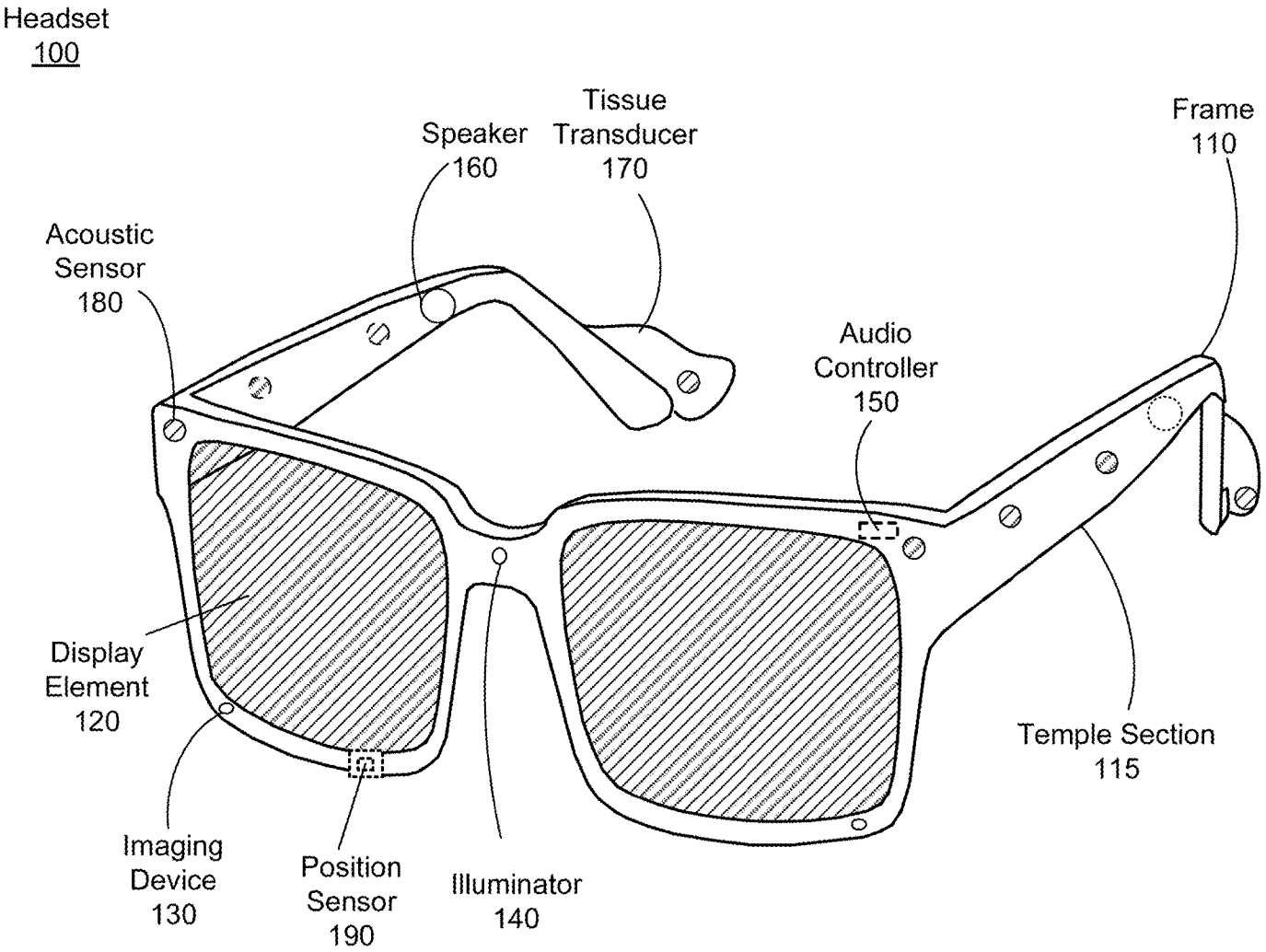
FIG. 1A is a perspective view of a headset implemented as an eyewear device, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Audio systems are disclosed herein that reduce feedback and reduce entrainment. Audio systems that process sounds received by a microphone and output the processed sounds via a speaker that is near the microphone, such as audio systems in artificial reality headsets, may suffer from feedback as a result of the closed loop formed between the microphone and the speaker, which amplifies the sounds output by the speaker.

The audio systems described herein utilize adaptive feedback cancellation systems that are configured to reduce feedback and mitigate entrainment in audio content presented to the user. The audio systems process reference signals in a hybrid of the time domain and the frequency domain to achieve rapid convergence with decreased entrainment. Thus, the attenuation of feedback sources is both fast and stable. The audio systems may pre-whiten reference signals and speaker signals and separate the pre-whitened signals into frequency bands using a filter bank. The audio systems use a state space algorithm to generate adaptive filters in each frequency band. The adaptive filters may be applied to the speaker signal to generate a feedback cancelation signal which may be subtracted from the reference signal to decrease feedback. In some embodiments, the adaptive filters may be applied in each frequency band. In some embodiments, a version of the adaptive filters may be applied in the time domain.

Some existing audio systems process the audio signal to remove feedback from the output speaker audio by using a feedforward processing technique. However, the feedback cancelation may suffer from entrainment distortion, in which the amplitude of the feedback attenuation rapidly oscillates as a result of the detected reference audio signal being highly correlated with the reference signal. The audio systems described herein decrease the entrainment distortion, resulting in a cleaner audio output to a user. Additionally, the audio systems described herein attenuate feedback faster than existing audio systems.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

FIG. 1A is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

In some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The audio system provides audio content. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents sound to user. The transducer array includes a plurality of transducers. A transducer may be a speaker 160 or a tissue transducer 170 (e.g., a bone conduction transducer or a cartilage conduction transducer). Although the speakers 160 are shown exterior to the frame 110, the speakers 160 may be enclosed in the frame 110. In some embodiments, instead of individual speakers for each ear, the headset 100 includes a speaker array comprising multiple speakers integrated into the frame 110 to improve directionality of presented audio content. The tissue transducer 170 couples to the head of the user and directly vibrates tissue (e.g., bone or cartilage) of the user to generate sound. The number and/or locations of transducers may be different from what is shown in FIG. 1A.

The sensor array detects sounds within the local area of the headset 100. The sensor array includes a plurality of acoustic sensors 180. An acoustic sensor 180 captures sounds emitted from one or more sound sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds. At least one of the acoustic sensors 180 may be a reference sensor, such as a reference microphone. The reference microphone may be configured to detect sounds emitted by a target source, such as a person talking. At least one of the acoustic sensors 180 may be an error sensor, such as an error microphone. The error sensor may be configured to detect sounds emitted from the transducer array. The error sensor may be configured to detect disturbance audio within the local area of the headset 100. The sounds detected by the error sensor may be used as an input to an adaptive feedback cancelation system to decrease feedback in the audio system.

In some embodiments, one or more acoustic sensors 180 may be placed in an ear canal of each ear (e.g., acting as binaural microphones). In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 processes information from the sensor array that describes sounds detected by the sensor array. The audio controller 150 may comprise a processor and a computer-readable storage medium. The audio controller 150 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 160, or some combination thereof.

The audio controller 150 is configured to adaptively cancel feedback in the audio system. The audio controller 150 is configured to mitigate entrainment and rapidly stabilize feedback. The audio controller 150 utilizes a feedforward processing algorithm, in conjunction with a state-space algorithm to cancel feedback. The functions of the audio controller 150 are described in further detail with respect to FIGS. 2-5.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof. The position sensor 190 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 190 tracks the position (e.g., location and pose) of the headset 100 within the room. Additional details regarding the components of the headset 100 are discussed below in connection with FIG. 5.

Figure 1B:
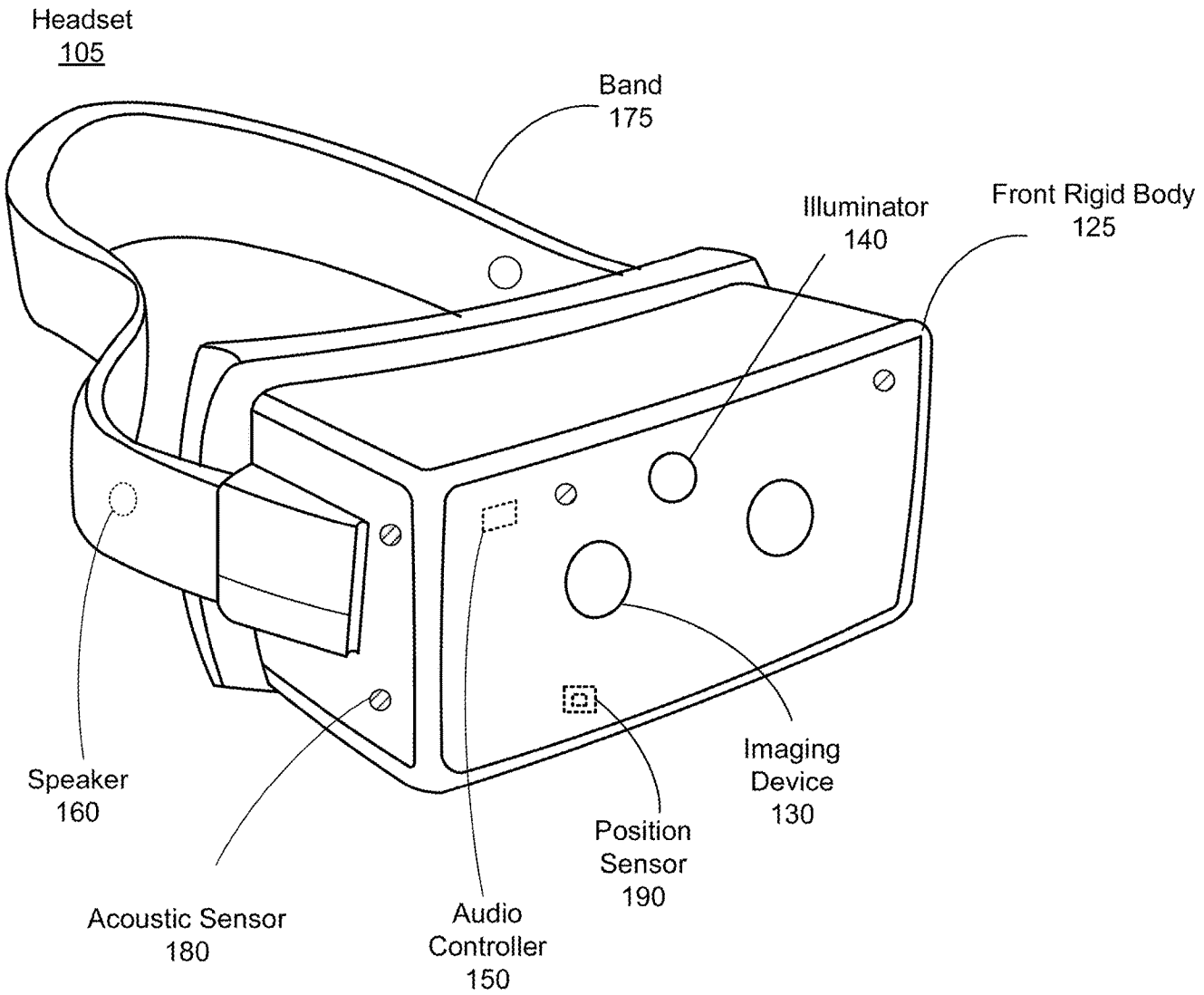
FIG. 1B is a perspective view of a headset implemented as a head-mounted display, in accordance with one or more embodiments.

FIG. 1B is a perspective view of a headset 105 implemented as a HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175.

The headset 105 includes many of the same components described above with reference to FIG. 1A, but modified to integrate with the HMD form factor. For example, the HMD includes a display assembly, a DCA, an audio system, and a position sensor 190. FIG. 1B shows the illuminator 140, a plurality of the speakers 160, a plurality of the imaging devices 130, a plurality of acoustic sensors 180, and the position sensor 190. The speakers 160 may be located in various locations, such as coupled to the band 175 (as shown), coupled to front rigid body 115, or may be configured to be inserted within the ear canal of a user. The audio system is configured to adaptively cancel feedback, as further described with respect to FIGS. 2-5.

Figure 2:
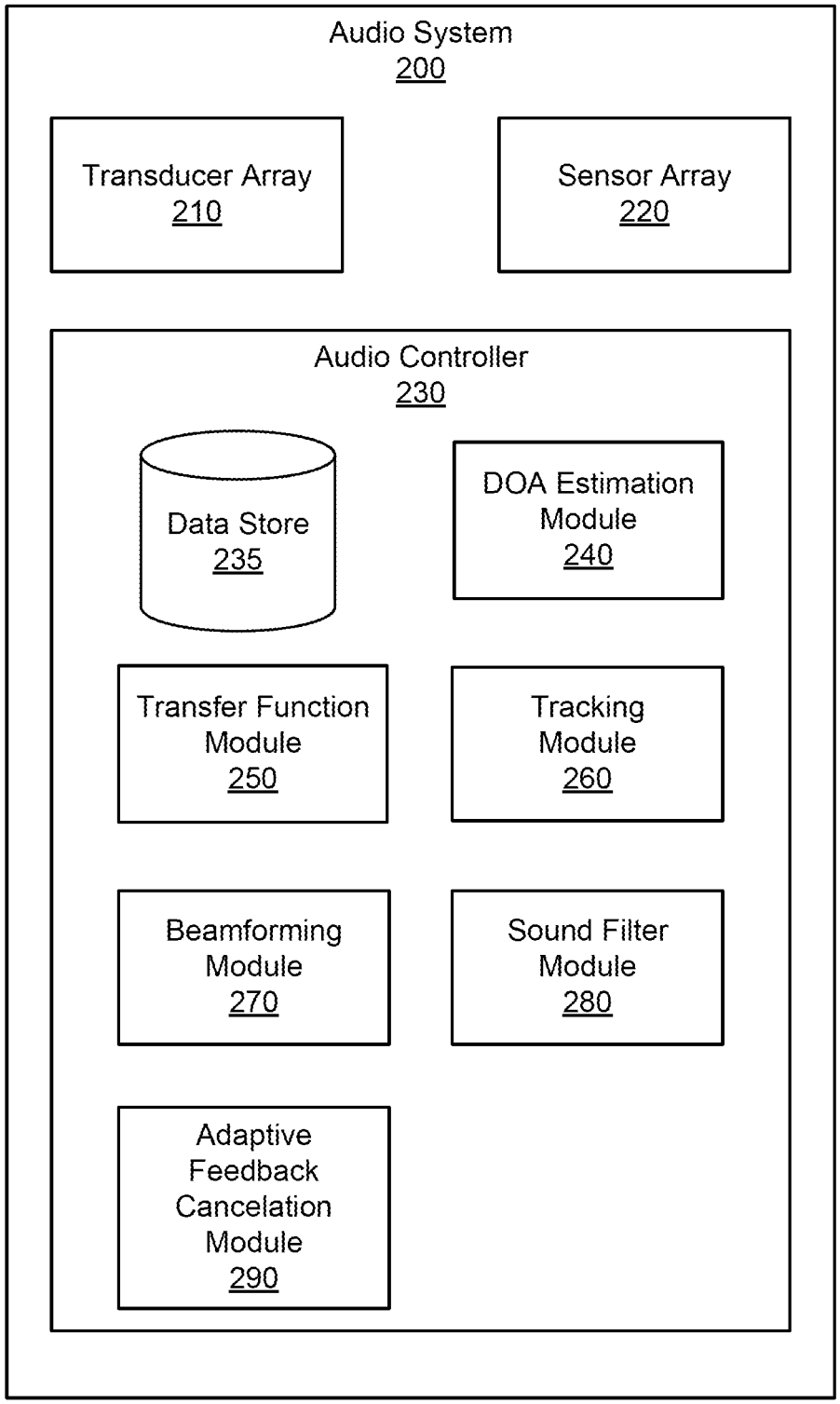
FIG. 2 is a block diagram of an audio system, in accordance with one or more embodiments.

FIG. 2 is a block diagram of an audio system 200, in accordance with one or more embodiments. The audio system in FIG. 1A or FIG. 1B may be an embodiment of the audio system 200. The audio system 200 generates one or more acoustic transfer functions for a user. The audio system 200 may then use the one or more acoustic transfer functions to generate audio content for the user. In the embodiment of FIG. 2, the audio system 200 includes a transducer array 210, a sensor array 220, and an audio controller 230. Some embodiments of the audio system 200 have different components than those described here. Similarly, in some cases, functions can be distributed among the components in a different manner than is described here.

The transducer array 210 is configured to present audio content. The transducer array 210 includes a plurality of transducers. A transducer is a device that provides audio content. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 210 may present audio content via air conduction (e.g., via one or more speakers), via bone conduction (via one or more bone conduction transducer), via cartilage conduction audio system (via one or more cartilage conduction transducers), or some combination thereof. In some embodiments, the transducer array 210 may include one or more transducers to cover different parts of a frequency range. For example, a piezoelectric transducer may be used to cover a first part of a frequency range and a moving coil transducer may be used to cover a second part of a frequency range.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 230, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 210 generates audio content in accordance with instructions from the audio controller 230. In some embodiments, the audio content is spatialized. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 200. The transducer array 210 may be coupled to a wearable device (e.g., the headset 100 or the headset 105). In alternate embodiments, the transducer array 210 may be a plurality of speakers that are separate from the wearable device (e.g., coupled to an external console).

The sensor array 220 detects sounds within a local area surrounding the sensor array 220. The sensor array 220 may include a plurality of acoustic sensors that each detect air pressure variations of a sound wave and convert the detected sounds into an electronic format (analog or digital). The plurality of acoustic sensors may be positioned on a headset (e.g., headset 100 and/or the headset 105), on a user (e.g., in an ear canal of the user), on a neckband, or some combination thereof. An acoustic sensor may be, e.g., a microphone, a vibration sensor, an accelerometer, or any combination thereof. In some embodiments, the sensor array 220 is configured to monitor the audio content generated by the transducer array 210 using at least some of the plurality of acoustic sensors. For example, at least one sensor in the sensor array 220 may comprise an error speaker configured to detect the audio content generated by the transducer array 210 in order to cancel feedback resulting from the sensor array 210 amplifying sounds emitted by the transducer array 210. Increasing the number of sensors may improve the accuracy of information (e.g., directionality) describing a sound field produced by the transducer array 210 and/or sound from the local area.

The audio controller 230 controls operation of the audio system 200. In the embodiment of FIG. 2, the audio controller 230 includes a data store 235, a DOA estimation module 240, a transfer function module 250, a tracking module 260, a beamforming module 270, a sound filter module 280, and an adaptive feedback cancelation module 290. The audio controller 230 may be located inside a headset, in some embodiments. Some embodiments of the audio controller 230 have different components than those described here. Similarly, functions can be distributed among the components in different manners than described here. For example, some functions of the controller may be performed external to the headset. The user may opt in to allow the audio controller 230 to transmit data captured by the headset to systems external to the headset, and the user may select privacy settings controlling access to any such data.

The data store 235 stores data for use by the audio system 200. Data in the data store 235 may include sounds recorded in the local area of the audio system 200, audio content, head-related transfer functions (HRTFs), transfer functions for one or more sensors, array transfer functions (ATFs) for one or more of the acoustic sensors, sound source locations, virtual model of local area, direction of arrival estimates, sound filters, and other data relevant for use by the audio system 200, or any combination thereof.

The DOA estimation module 240 is configured to localize sound sources in the local area based in part on information from the sensor array 220. Localization is a process of determining where sound sources are located relative to the user of the audio system 200. The DOA estimation module 240 performs a DOA analysis to localize one or more sound sources within the local area. The DOA analysis may include analyzing the intensity, spectra, and/or arrival time of each sound at the sensor array 220 to determine the direction from which the sounds originated. In some cases, the DOA analysis may include any suitable algorithm for analyzing a surrounding acoustic environment in which the audio system 200 is located.

For example, the DOA analysis may be designed to receive input signals from the sensor array 220 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 220 received the direct-path audio signal. The determined angle may then be used to identify the DOA for the received input signal. Other algorithms not listed above may also be used alone or in combination with the above algorithms to determine DOA.

In some embodiments, the DOA estimation module 240 may also determine the DOA with respect to an absolute position of the audio system 200 within the local area. The position of the sensor array 220 may be received from an external system (e.g., some other component of a headset, an artificial reality console, a mapping server, a position sensor (e.g., the position sensor 190), etc.). The external system may create a virtual model of the local area, in which the local area and the position of the audio system 200 are mapped. The received position information may include a location and/or an orientation of some or all of the audio system 200 (e.g., of the sensor array 220). The DOA estimation module 240 may update the estimated DOA based on the received position information.

The transfer function module 250 is configured to generate one or more acoustic transfer functions. Generally, a transfer function is a mathematical function giving a corresponding output value for each possible input value. Based on parameters of the detected sounds, the transfer function module 250 generates one or more acoustic transfer functions associated with the audio system. The acoustic transfer functions may be array transfer functions (ATFs), head-related transfer functions (HRTFs), other types of acoustic transfer functions, or some combination thereof. An ATF characterizes how the microphone receives a sound from a point in space.

An ATF includes a number of transfer functions that characterize a relationship between the sound source and the corresponding sound received by the acoustic sensors in the sensor array 220. Accordingly, for a sound source there is a corresponding transfer function for each of the acoustic sensors in the sensor array 220. And collectively the set of transfer functions is referred to as an ATF. Accordingly, for each sound source there is a corresponding ATF. Note that the sound source may be, e.g., someone or something generating sound in the local area, the user, or one or more transducers of the transducer array 210. The ATF for a particular sound source location relative to the sensor array 220 may differ from user to user due to a person's anatomy (e.g., ear shape, shoulders, etc.) that affects the sound as it travels to the person's ears. Accordingly, the ATFs of the sensor array 220 are personalized for each user of the audio system 200.

In some embodiments, the transfer function module 250 determines one or more HRTFs for a user of the audio system 200. The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function module 250 may determine HRTFs for the user using a calibration process. In some embodiments, the transfer function module 250 may provide information about the user to a remote system. The user may adjust privacy settings to allow or prevent the transfer function module 250 from providing the information about the user to any remote systems. The remote system determines a set of HRTFs that are customized to the user using, e.g., machine learning, and provides the customized set of HRTFs to the audio system 200.

The tracking module 260 is configured to track locations of one or more sound sources. The tracking module 260 may compare current DOA estimates and compare them with a stored history of previous DOA estimates. In some embodiments, the audio system 200 may recalculate DOA estimates on a periodic schedule, such as once per second, or once per millisecond. The tracking module may compare the current DOA estimates with previous DOA estimates, and in response to a change in a DOA estimate for a sound source, the tracking module 260 may determine that the sound source moved. In some embodiments, the tracking module 260 may detect a change in location based on visual information received from the headset or some other external source. The tracking module 260 may track the movement of one or more sound sources over time. The tracking module 260 may store values for a number of sound sources and a location of each sound source at each point in time. In response to a change in a value of the number or locations of the sound sources, the tracking module 260 may determine that a sound source moved. The tracking module 260 may calculate an estimate of the localization variance. The localization variance may be used as a confidence level for each determination of a change in movement.

The beamforming module 270 is configured to process one or more ATFs to selectively emphasize sounds from sound sources within a certain area while de-emphasizing sounds from other areas. In analyzing sounds detected by the sensor array 220, the beamforming module 270 may combine information from different acoustic sensors to emphasize sound associated from a particular region of the local area while deemphasizing sound that is from outside of the region. The beamforming module 270 may isolate an audio signal associated with sound from a particular sound source from other sound sources in the local area based on, e.g., different DOA estimates from the DOA estimation module 240 and the tracking module 260. The beamforming module 270 may thus selectively analyze discrete sound sources in the local area. In some embodiments, the beamforming module 270 may enhance a signal from a sound source. For example, the beamforming module 270 may apply sound filters which eliminate signals above, below, or between certain frequencies. Signal enhancement acts to enhance sounds associated with a given identified sound source relative to other sounds detected by the sensor array 220.

In some embodiments, the beamforming module 270 may determine that sounds detected from an area other than a target sound source are a disturbance noise. For example, the beamforming module 270 may form a beam in the direction of a person in a crowded room, and sounds detected by the sensor array 220 from persons in other areas of the crowded room may be labeled as disturbance noise. Sounds detected by the sensor array 220 that are emitted by the transducer array 210 may be labeled as a disturbance noise. The audio controller 150 may provide a signal generated by the disturbance noises to the adaptive feedback cancelation module 290 in order to decrease the output of the disturbance noises by the transducer array 210.

The sound filter module 280 determines sound filters for the transducer array 210. In some embodiments, the sound filters cause the audio content to be spatialized, such that the audio content appears to originate from a target region. The sound filter module 280 may use HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the sound filter module 280 calculates one or more of the acoustic parameters. In some embodiments, the sound filter module 280 requests the acoustic parameters from a mapping server (e.g., as described below with regard to FIG. 5). In some embodiments, the sound filter module 280 determines the sound filters based on information provided to the sound filter module 280 by the adaptive feedback cancelation module 290.

The sound filter module 280 provides the sound filters to the transducer array 210. In some embodiments, the sound filters may cause positive or negative amplification of sounds as a function of frequency.

The adaptive feedback cancelation module 290 is configured to reduce feedback in the audio system. The adaptive feedback cancelation module 290 is configured to feedforward process a signal generated by the sensor array 210. The adaptive feedback cancelation module 290 processes a reference signal in a combination of the time domain and the frequency domain in order to rapidly attenuate feedback and reduce entrainment. The adaptive feedback cancelation module 290 is configured to mitigate entrainment in a speaker signal by processing an error signal and the speaker signal in the frequency domain using state space filtering. The adaptive feedback cancelation module 290 may generate a feedback signal based on the state space filtering. The adaptive feedback cancelation module 290 may update the error signal by subtracting the feedback signal from the reference signal. The adaptive feedback cancelation module 290 may feedforward process the updated error signal and provide an updated speaker signal to the transducer array 220 for presentation of sound to a user. In some embodiments, the adaptive feedback cancelation module 290 may be utilized for echo cancelation using similar processes described herein with reference to feedback cancelation. The modules and functions of the adaptive feedback cancelation module 290 are further described with reference to FIG. 3A and FIG. 3B.

Figure 3A:
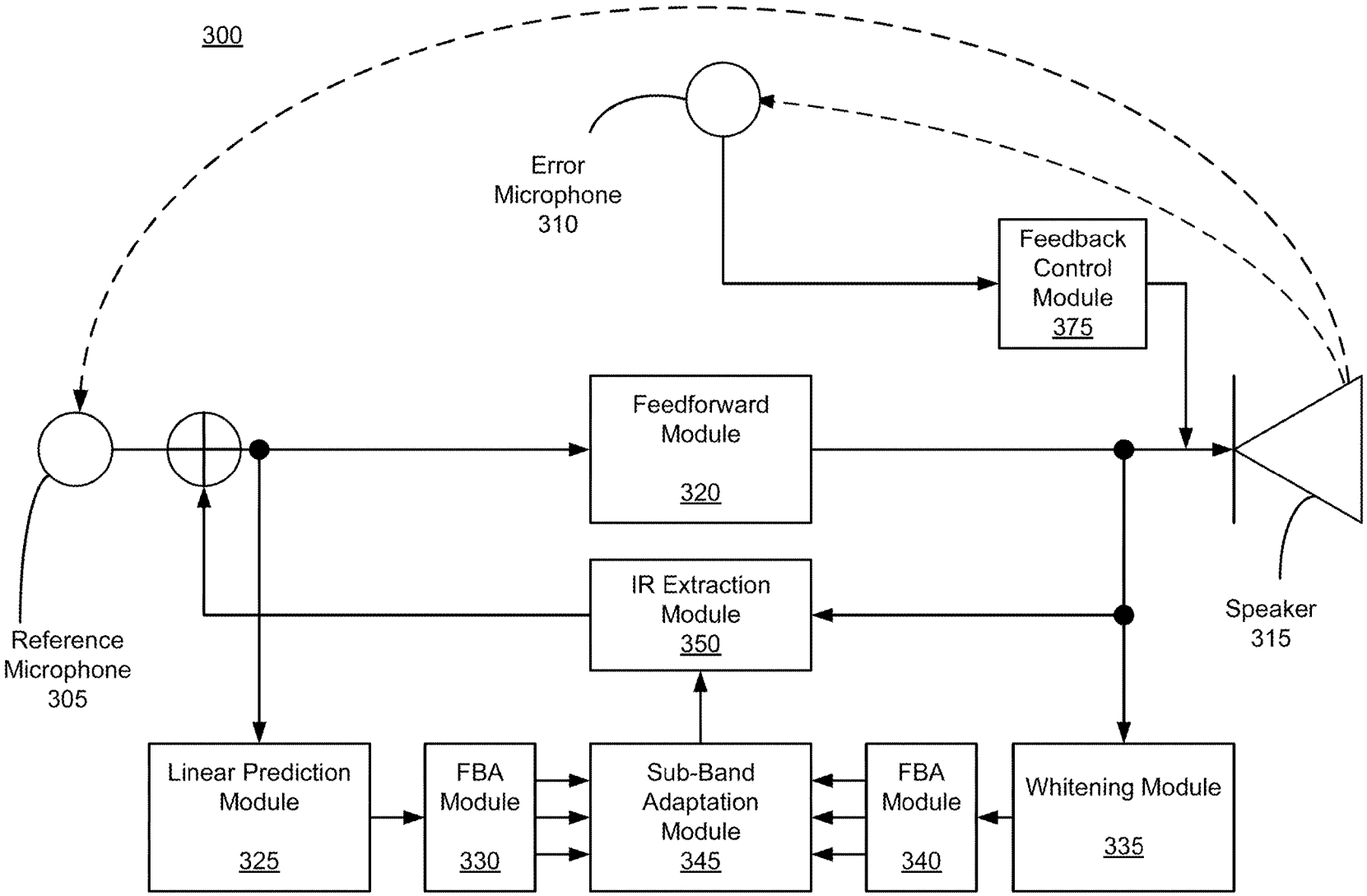
FIG. 3A is a block diagram of an adaptive feedback cancelation system, in accordance with one or more embodiments.

FIG. 3A is a schematic diagram of an adaptive feedback cancelation module 300 in accordance with one or more embodiments. The adaptive feedback cancelation module 300 may be an embodiment of the adaptive feedback cancelation module 290 of FIG. 2. The adaptive feedback cancelation module 300 is configured to process a reference signal in a combination of the time domain and the frequency domain in order to rapidly attenuate feedback and reduce entrainment. The adaptive feedback cancelation is configured to receive a reference signal from a reference microphone 305 and an error signal from an error microphone 310, process the signals to prevent feedback and mitigate entrainment, and provide a speaker signal to a speaker 315. The error microphone 310 may be configured to be located within an ear canal of a user. The reference microphone 305 and the error microphone 310 may be embodiments of acoustic sensors of the sensor array 210 of FIG. 2. The speaker 315 may be an embodiment of a transducer of the transducer array 220 of FIG. 2. A portion of the sound emitted by the speaker 315 may be detected by the reference microphone 305, which creates a feedback path that may create unwanted distortion in sound emitted by the speaker 315. The adaptive feedback cancelation module 300 may comprise an adaptive feedforward module 320, a linear prediction module 325, a filter bank analysis (FBA) module 330, a whitening module 335, an FBA module 340, a sub-band adaptation module 345, an impulse response (IR) extraction module 350, and a feedback control module 375.

The adaptive feedforward module 320 is configured to feedforward process a received signal to decrease distortion such as feedback and disturbance audio. The received signal is an error signal, which is calculated by subtracting a feedback cancelation signal from a reference signal generated by the reference microphone 305. The feedforward processing may employ stabilizing blocks that help a feedback canceler stabilize the closed loop during a path change. For example, the adaptive feedforward module 320 may employ a frequency shifting module that gets triggered via a decision by the feedback canceler. The adaptive feedforward module 320 may apply hearing correction gain, speech enhancement, noise suppression, or some combination thereof. The adaptive feedforward module 320 generates a speaker signal which is provided to the speaker 315 to generate audio content for a user. The adaptive feedback cancelation module 300 also provides the speaker signal to the whitening module 335.

The linear prediction module 325 is configured to predict an error signal and whiten (e.g., make the spectrum more uniform) a received error signal prior to the sub-band adaptation module 345 processing the error signal. The linear prediction module 325 estimates linear prediction filters based on error signals and whitens the error signals by applying the estimated linear prediction filters to the error signals. Whitening the error signal and/or the speaker signal helps mitigate an undesired correlation between the error signal and the speaker signal. Decreasing the correlation between the error signal and the speaker signal may decrease entrainment. The linear prediction module 325 processes the signal in the time domain. The linear prediction module 325 may execute a lattice filtering algorithm. A lattice filter is a type of all-pass filter, such that the attenuation of the filter is constant at all frequencies but the relative phase between input and output varies with frequency. The linear prediction module 325 may normalize the signal such that the signal comprises a roughly equivalent strength component at each frequency. The linear prediction module 325 may analyze a set of audio frames, such as the one hundred previously received audio frames, in order to predict a subsequent audio frame. The linear prediction module 325 may subtract the predicted audio frame from the subsequently received audio frame and output the resulting whitened error signal to the FBA module 330. The linear prediction module 325 may calculate whitening coefficients for each frequency band of the signal, such as by using a stochastic gradient algorithm, least mean square algorithm, normalized least mean square algorithm, any other suitable algorithm, or some combination thereof. The linear prediction module 325 may provide the whitening coefficients to the whitening module 335.

The FBA module 330 is configured to convert the whitened error signal received from the linear prediction module 325 from the time domain to the frequency domain. The FBA module 330 separates the signal into a plurality of frequency bands. In some embodiments, the plurality of frequency bands may comprise three, five, ten, or any other suitable number of frequency bands. The plurality of frequency bands may span the auditory range of humans (e.g., approximately 20-20,000 Hz). In some embodiments, the frequency resolution may be the same for each frequency band. The number of frequency bands may depend on the hop-size. The hop-size is the amount of new samples collected before executing frequency band analysis. Increasing the hop-size increases the delay before a sub-band adaptive filter update cancels feedback. However, increasing the hop-size may also improve the frequency resolution. Thus, the FBA module 330 may select a hop-size that quickly cancels feedback while maintaining sufficient frequency resolution. The FBA module 330 provides a signal for each frequency band to the sub-band adaptation module 345. Due to the block-based nature of frequency domain processing, modeling of relatively long filter lengths is possible with reasonable computational complexity. Frequency domain processing decomposes signals into frequency components that are adequately un-correlated. This allows different adaptation rules customized for each sub-band, such as responding to entrainment differently in different sub-bands. The different adaptation rules may increase the convergence rate, especially where signals have a high degree of auto-correlation, such as is the case with human speech.

The whitening module 335 is configured to whiten the speaker signal output by the adaptive feedforward module 320. The whitening module 335 may apply a whitening filter to the speaker signal. The whitening module 335 may utilize the whitening coefficients received from the linear prediction module 325 to generate the whitening filter. In some embodiments, the whitening module 335 may independently calculate whitening coefficients, as described with respect to the linear prediction module 325. In some embodiments, the whitening module 335 applies the linear prediction filters estimated by the linear prediction module 325 to the speaker signal. The whitening module outputs the whitened speaker signal to the FBA module 340.

The FBA module 340 is configured to convert the whitened speaker signal received from the whitening module 335 from the time domain to the frequency domain. The FBA module 340 separates the signal into a plurality of frequency bands. The plurality of frequency bands may correspond to the same frequency bands output by FBA module 330. The FBA module 340 provides a signal for each frequency band to the sub-band adaptation module 345.

The sub-band adaptation module 345 is configured to generate adaptation filters for each frequency band to mitigate entrainment in the speaker output signal. The sub-band adaptation module 345 receives the whitened error signal from the FBA module 330 and the whitened speaker signal from the FBA module 340 in each frequency band. The sub-band adaptation module 345 executes a state-space algorithm on each pair of signals received from the FBA module 330 and the FBA module 340 for each frequency band. The FBA module 330 and the FBA module 340 may be configured such that the output of each corresponds to the same frequency sub-band, allowing the sub-band adaptation module 345 to correlate the signals into a pair. The state-space algorithm outputs an adaptation filter for each frequency band. The state-space algorithm is configured to minimize the whitened error signal in each frequency band, such as by using a class of affine-projection, recursive-least squares, recursive Bayesian filters, or some combination thereof. The sub-band adaptation module 345 may model entrainment artifacts as observation noise. The entrainment may cause the adaptation filters to oscillate about a convergence floor, which may in turn result in an increase in the energy of the error signal. State-space algorithms may be configured to track and respond as the observation noise in the system changes. For example, the adaptation may be slower when observation noise increases, and the adaptation may be faster when observation noise decreases. Observation noise tracking of the state-space adaptive filter, if based on the error signal energy, may automatically begin to track the entrainment artifacts. When the entrainment artifacts are significant, the state-space filter may respond by adjusting the adaptation rate accordingly and minimize the loss of convergence. The sub-band adaptation module 345 provides a relatively small time constant for covariance update, resulting in a fast convergence of mitigation of feedback. The time constant regulates the speed at which the state-space filter is updated. In some embodiments, the time constants may be approximately 1-1000 ms, 1-5 seconds, or any other suitable length of time. The sub-band adaptation module 345 combines the resulting adaptation filters for each frequency band into a set of filters that may be applied in the time domain. The sub-band adaptation module 345 provides the set of filters to the IR extraction module 350.

The IR extraction module 350 is configured to convert the speaker signal into a feedback cancelation signal for entrainment mitigation. The IR extraction module 350 applies the set of filters received from the sub-band adaptation module 345 to the speaker signal in the time domain to generate the feedback cancelation signal. The IR extraction module 350 may convert the set of filters received from the sub-band adaptation module 345 to one time-domain monolith, such as the IR. The adaptive feedback cancelation module 300 subtracts the feedback cancelation signal from the reference signal, resulting in an updated error signal. The IR extraction module 350 may use the time-domain monolith to remove feedback from the reference signal to produce the time-domain error signal. In some embodiments, the feedback cancelation signal is subtracted from the reference signal using sample-by-sample time-domain subtraction, time domain subtraction of a block of data via overlap-save convolution based on a fast Fourier transform (FFT), and time domain subtraction of a block of data via multi-delay convolution based on FFT. The IR extraction module 350 may provide delay correction, which facilitates sub-band adaptive filtering in the specified configuration. The updated error signal is provided to the adaptive feedforward module 320 and the linear prediction module 325 for speaker output and further processing.

The feedback control module 375 is configured to control feedback between the speaker 315 and the error microphone 310. The feedback control module 375 is configured to reduce noise within the ear canal of the user as well as reduce the boominess sound of a user's own voice. The feedback control module 375 is configured to minimize the signal detected by the error microphone 310, which results in minimization of noise detected by the user's eardrum. When objects occlude the user's ear canal, such as objects that are located within the ear canal of the user or over the user's ear, the user's voice may sound boomy without feedback control. The feedback control module 375 is discussed in more detail with reference to FIG. 3C and FIG. 3D.

Figure 3B:
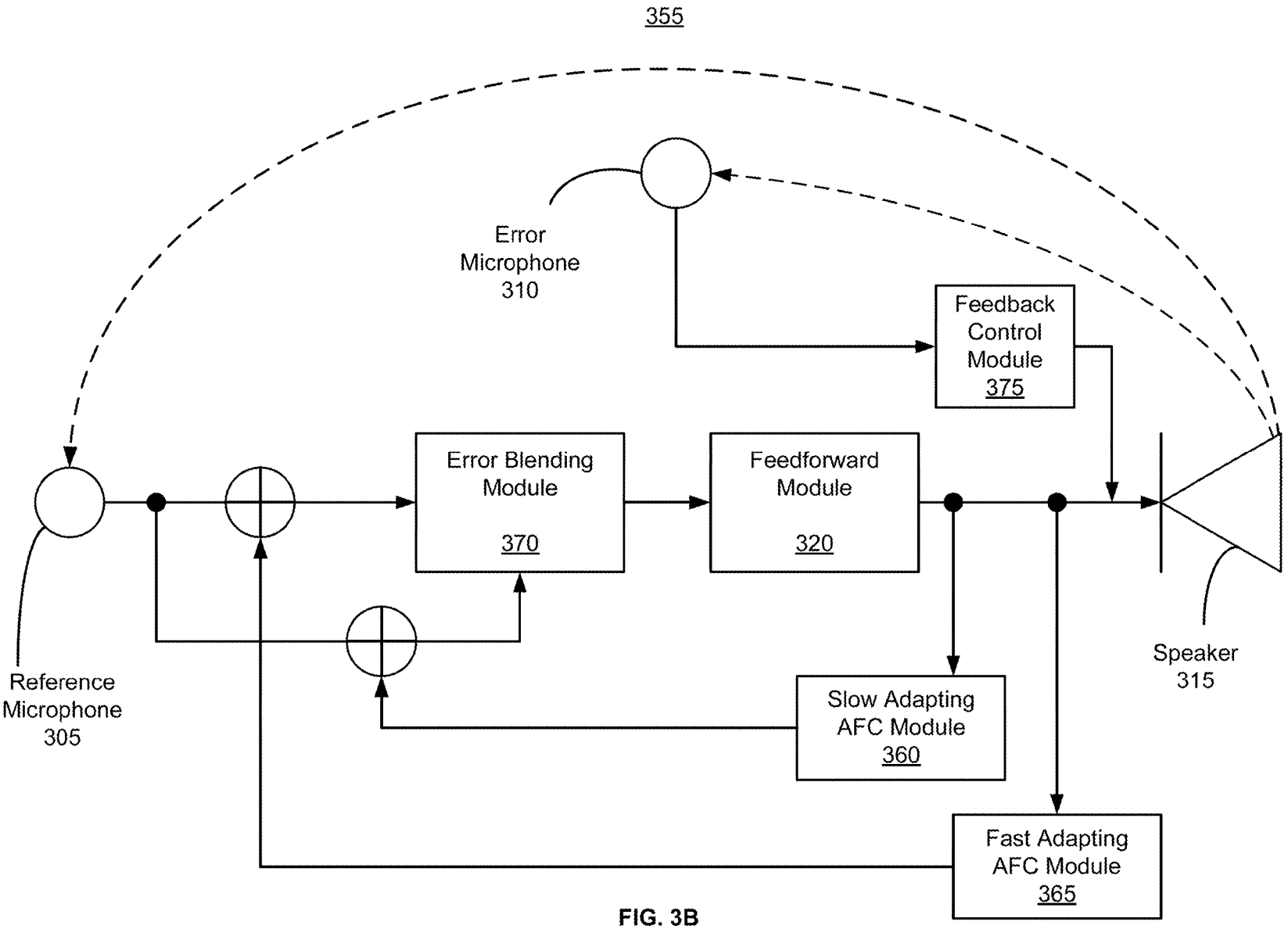
FIG. 3B is a block diagram of a dual adaptive feedback cancelation system, in accordance with one or more embodiments.

FIG. 3B is a schematic diagram of a dual adaptive feedback cancelation module 355 in accordance with one or more embodiments. The dual adaptive feedback cancelation module 355 may be an embodiment of the adaptive feedback cancelation module 290 of FIG. 2. The dual adaptive feedback cancelation module 355 may comprise the reference microphone 305, the error microphone 310, the speaker 315, and the feedforward module 320 as described with reference to FIG. 3A. The dual adaptive feedback cancelation module 355 may comprise a slow adapting AFC module 360 and a fast adapting AFC module 365. The slow adapting AFC module 360 and the fast adapting AFC module 365 may each comprise one or more of a linear prediction module, an FBA module, a whitening module, a sub-band adaptation module, and an IR extraction module, as described with reference to FIG. 3A. The dual adaptive feedback cancelation module 355 may further comprise an error blending module 370.

The dual adaptive feedback cancelation module 355 is configured to blend errors continuously. The dual adaptive feedback cancelation module 355 may trigger frequency shifting only when needed, such as to help rapidly stabilize the system. The dual adaptive feedback cancelation module 355 may result in minimal distortion in steady-state operation. The dual adaptive feedback cancelation module 355 may be less distortive as compared to a conventional adaptive feedback cancelation system.

The slow adapting AFC module 360 is configured to cancel feedback during steady-state operation. The slow adapting AFC module 360 may result in minimal distortion of sound output by the speaker 315. The slow adapting AFC module 360 is configured to output a slow adapting feedback cancelation signal which is subtracted from the reference signal to generate a slow adapting error signal which is provided to the error blending module 370.

The fast adapting AFC module 365 is configured to cancel feedback to stabilize the closed loop as fast as possible. The fast adapting AFC module 365 may be particularly useful when variation of feedback coupling is high, i.e., in response to a sudden path change in the closed loop. The fast adapting AFC module 365 may kick in when a path change is happening. The fast adapting AFC module 365 is configured to output a fast adapting feedback cancelation signal which is subtracted from the reference signal to generate a fast adapting error signal which is provided to the error blending module 370.

The error blending module 370 is configured to blend the slow adapting error signal and the fast adapting error signal. The error blending module 370 may output an error signal to the feedforward module 320. The feedforward module 320 may generate the speaker signal for the speaker 315, as described with reference to FIG. 3A.

Figure 3C:
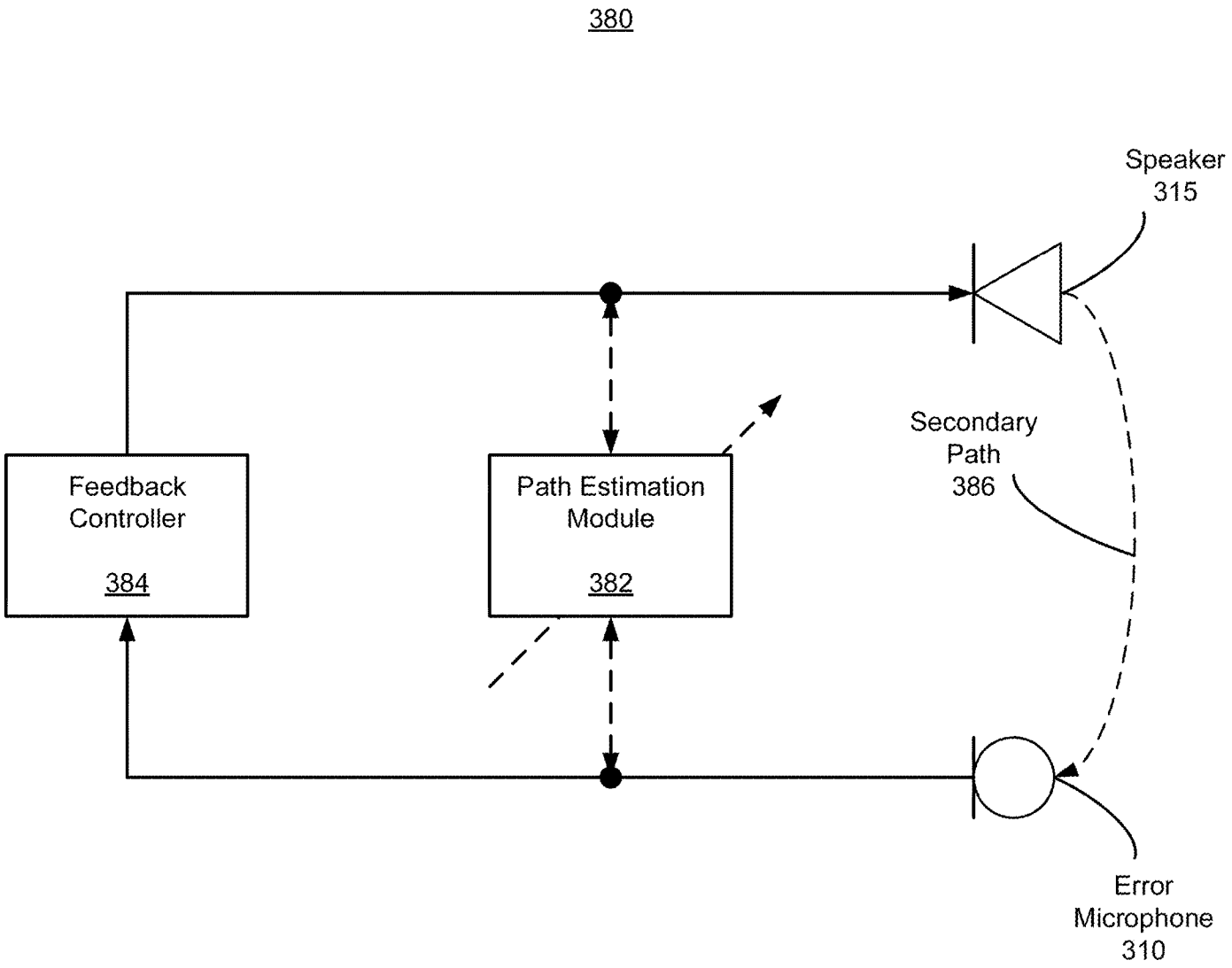
FIG. 3C is a schematic diagram of a feedback control module, in accordance with one or more embodiments.

FIG. 3C is a schematic diagram of a feedback control module 380 in accordance with one or more embodiments. The feedback control module 380 may be an embodiment of the feedback control module 375 of FIG. 3A. The feedback control module 380 may comprise a path estimation module 382 and a feedback controller 384. The path estimation module 382 is configured to estimate the secondary path 386, i.e., electro-acoustic coupling, between the speaker 315 and the error microphone 310. The secondary path 386 may be estimated after the speaker 315 is placed within the ear canal of the user. The secondary path 386 may be averaged over an interval to obtain a mean secondary path. The feedback controller is configured to generate a desired closed loop response based on the estimated secondary path. The feedback controller is configured to filter the error signal generated by the error microphone 310 in order to minimize the error signal, as further described with reference to FIG. 3D.

Figure 3D:
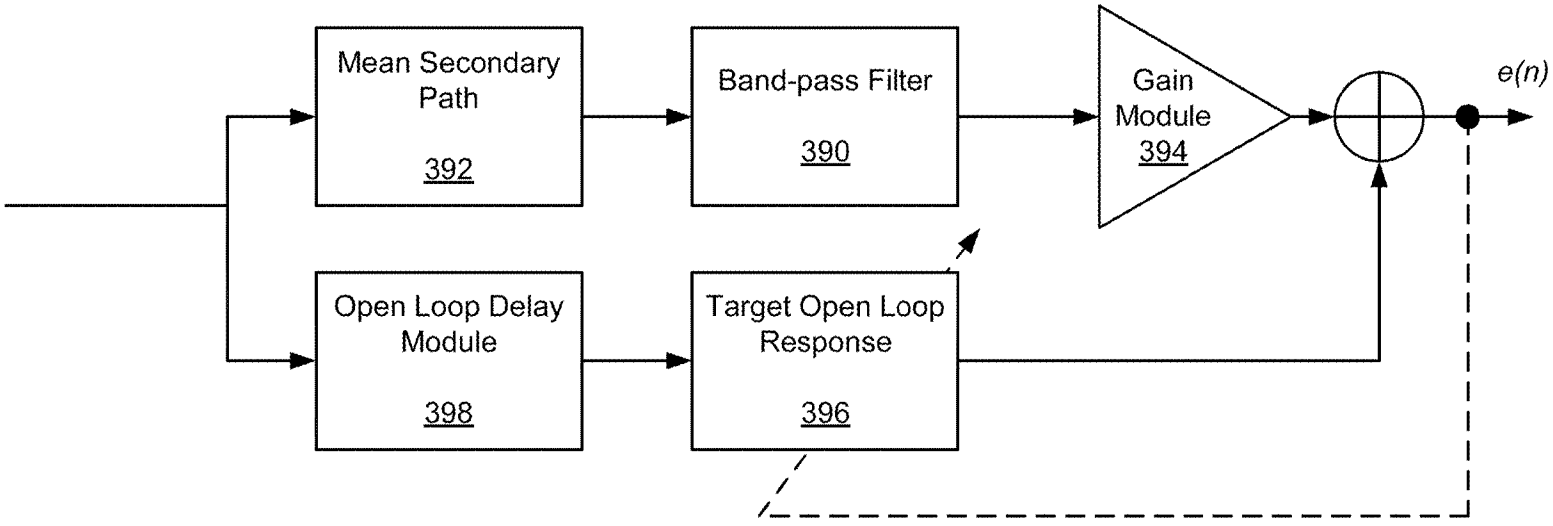
FIG. 3D is a schematic diagram showing the design of target open loop response, in accordance with one or more embodiments.

FIG. 3D is a schematic diagram showing the design of target open loop response, which is necessary for feedback controller extraction, via adaptive minimization of mean squared error in the presence of broadband excitation, in accordance with one or more embodiments. The open loop response is the product of the band-pass filter and the secondary path. In one embodiment, the open loop response is devised by applying a band-pass filter 390 to the mean secondary path 392 estimated by the path estimation module 382 shown in FIG. 3C. The band-pass filter 390 may be used to place stability constraints on the open loop response, to be estimated in 399, by suppressing gain in bands where gain and phase safety margins are expected to be violated. A gain module 394 may modify the amplitude of the filtered secondary path. The gain may be increased to more aggressively suppress noise and mitigate occlusion. The target open loop response 396 may be learned to adaptively minimize the error signal. The open loop delay module 398 may be used to adjust or counter the excessive delay introduced by the application of band-pass filter to the mean secondary path.

Figure 3E:
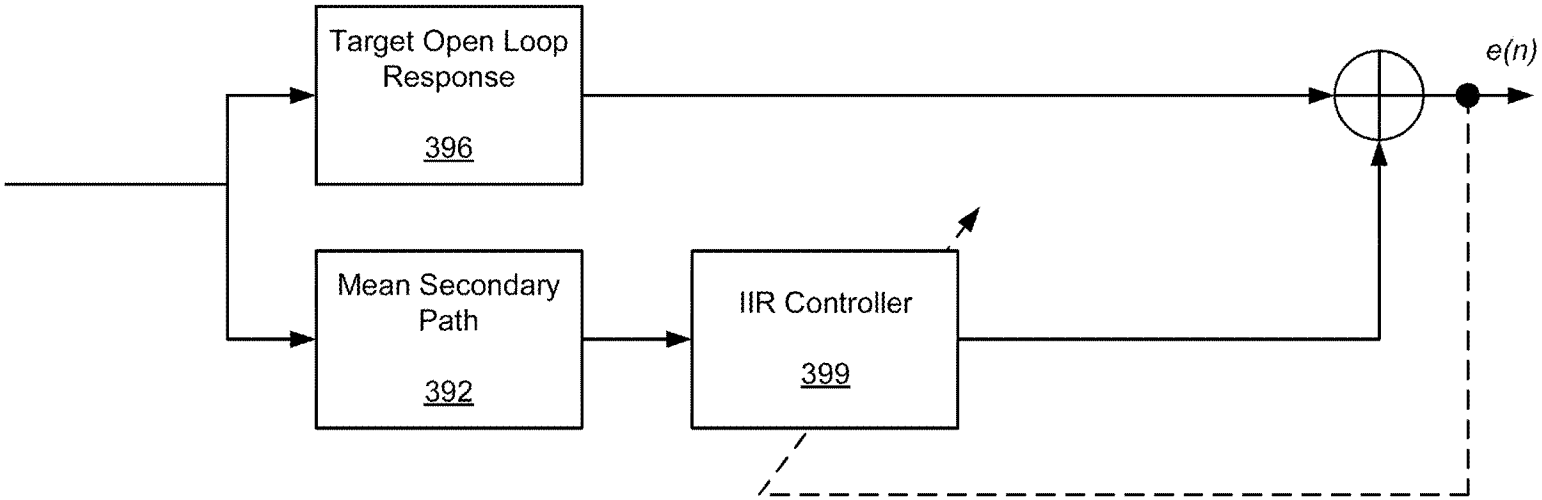
FIG. 3E is a schematic diagram showing how the feedback controller extracts an IIR controller, in accordance with one or more embodiments.

FIG. 3E is a schematic diagram showing how the feedback controller extracts an IIR controller 399 by modeling it as an auto regressive moving average (ARMA) process, in accordance with one or more embodiments. The feedback controller estimation may utilize the target open loop response 396 and the mean secondary path 392 determined with reference to FIG. 3D. The feedback controller 399 may be learned via ARMA model estimation using filtered-x deconvolution. In one embodiment, filtered-x deconvolution enables factorization of an arbitrary response in terms of a known factor "x". Setting "x" as the mean secondary response enables the learning of the ARMA controller. The ARMA controller 399 may be learned to minimize the error signal. The signal generated by the ARMA controller 399 may be subtracted from the target open loop response 396 to generate the error signal e(n).

Figure 4:
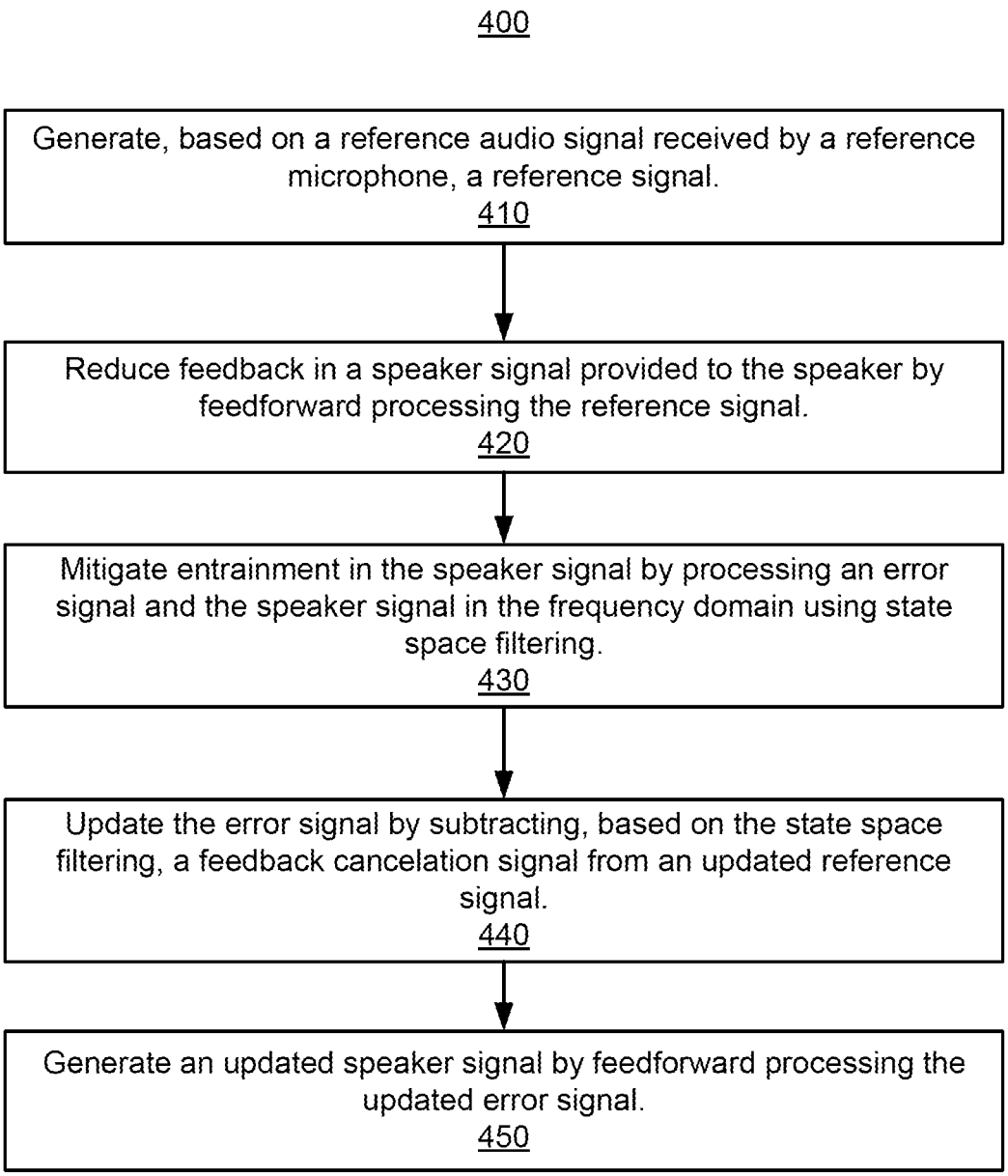
FIG. 4 is a flowchart illustrating a process for adaptively canceling feedback, in accordance with one or more embodiments.

FIG. 4 is a flowchart 400 of a method of adaptive feedback cancellation, in accordance with one or more embodiments. The process shown in FIG. 4 may be performed by components of an audio system (e.g., audio system 200). Other entities may perform some or all of the steps in FIG. 4 in other embodiments. Embodiments may include different and/or additional steps, or perform the steps in different orders.

The audio system may generate 410, based on a reference audio signal received by a reference microphone, a reference signal. The reference microphone may detect sounds from a local area. The detected sounds may be from a target sound source isolated by a beamformer. The reference microphone may output a signal representing the detected sounds.

The audio system may reduce 420 feedback in a speaker signal provided to a speaker by feedforward processing the reference signal. The speaker may be configured to provide audio output to a wearer of a headset. The reference microphone may detect the audio output, which results in a feedback path between the speaker and the reference microphone. The audio system may subtract a feedback cancelation signal from the reference signal prior to feedforward processing the reference signal.

The audio system may mitigate 430 entrainment in the speaker signal by processing an error signal and the speaker signal in the frequency domain using state space filtering. The error signal may be calculated by subtracting the feedback cancelation signal from the reference signal. The audio system may whiten the error signal using a lattice filtering algorithm. The speaker signal may be whitened using whitening coefficients calculated in the lattice filtering algorithm. The whitened signals may be separated into frequency bands by respective filter banks. The audio system may generate an adaptive filter for each frequency band using a state space algorithm. The adaptive filters may be recombined and applied to the speaker signal to generate a feedback cancelation signal.

The audio system may update 440 the error signal by subtracting, based on the state space filtering, the feedback cancelation signal from an updated reference signal. The updated reference signal may be generated by the reference speaker subsequent to the previous reference signal.

The audio system may generate 450 an updated speaker signal by feedforward processing the updated error signal. The updated speaker signal may be provided to the speaker to generate audio output to a user. The audio system may continuously process current reference signals and speaker signals in order to prevent feedback and mitigate entrainment.

Figure 5:
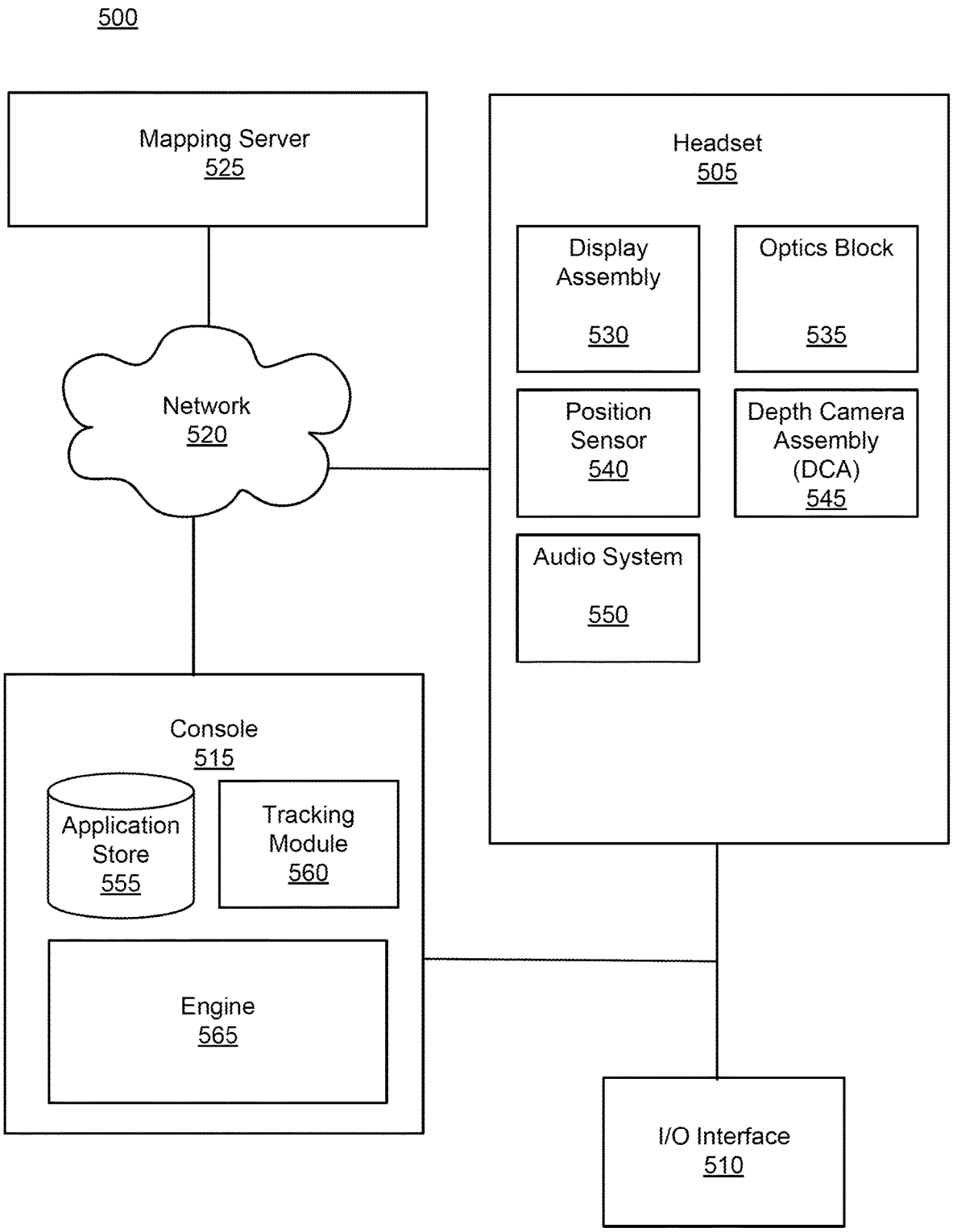
FIG. 5 is a system that includes a headset, in accordance with one or more embodiments.

FIG. 5 is a system 500 that includes a headset 505, in accordance with one or more embodiments. In some embodiments, the headset 505 may be the headset 100 of FIG. 1A or the headset 105 of FIG. 1B. The system 500 may operate in an artificial reality environment (e.g., a virtual reality environment, an augmented reality environment, a mixed reality environment, or some combination thereof). The system 500 shown by FIG. 5 includes the headset 505, an input/output (I/O) interface 510 that is coupled to a console 515, the network 520, and the mapping server 525. While FIG. 5 shows an example system 500 including one headset 505 and one I/O interface 510, in other embodiments any number of these components may be included in the system 500. For example, there may be multiple headsets each having an associated I/O interface 510, with each headset and I/O interface 510 communicating with the console 515. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 515 may be provided by the headset 505.

The headset 505 includes the display assembly 530, an optics block 535, one or more position sensors 540, and the DCA 545. Some embodiments of headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The display assembly 530 displays content to the user in accordance with data received from the console 515. The display assembly 530 displays the content using one or more display elements (e.g., the display elements 120). A display element may be, e.g., an electronic display. In various embodiments, the display assembly 530 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 535.

The optics block 535 may magnify image light received from the electronic display, corrects optical errors associated with the image light, and presents the corrected image light to one or both eyeboxes of the headset 505. In various embodiments, the optics block 535 includes one or more optical elements. Example optical elements included in the optics block 535 include: an aperture, a Fresnel lens, a convex lens, a concave lens, a filter, a reflecting surface, or any other suitable optical element that affects image light. Moreover, the optics block 535 may include combinations of different optical elements. In some embodiments, one or more of the optical elements in the optics block 535 may have one or more coatings, such as partially reflective or anti-reflective coatings.

Magnification and focusing of the image light by the optics block 535 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 535 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 535 corrects the distortion when it receives image light from the electronic display generated based on the content.

The position sensor 540 is an electronic device that generates data indicating a position of the headset 505. The position sensor 540 generates one or more measurement signals in response to motion of the headset 505. The position sensor 190 is an embodiment of the position sensor 540. Examples of a position sensor 540 include: one or more IMUS, one or more accelerometers, one or more gyroscopes, one or more magnetometers, another suitable type of sensor that detects motion, or some combination thereof. The position sensor 540 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 505 from the sampled data. For example, the IMU integrates the measurement signals received from the accelerometers over time to estimate a velocity vector and integrates the velocity vector over time to determine an estimated position of a reference point on the headset 505. The reference point is a point that may be used to describe the position of the headset 505. While the reference point may generally be defined as a point in space, however, in practice the reference point is defined as a point within the headset 505.

The DCA 545 generates depth information for a portion of the local area. The DCA includes one or more imaging devices and a DCA controller. The DCA 545 may also include an illuminator. Operation and structure of the DCA 545 is described above with regard to FIG. 1A.

The audio system 550 provides audio content to a user of the headset 505. The audio system 550 may be substantially the same as the audio system 200 describe above. The audio system 550 may comprise one or acoustic sensors, one or more transducers, and an audio controller. The audio system 550 may provide spatialized audio content to the user. In some embodiments, the audio system 550 may request acoustic parameters from the mapping server 525 over the network 520. The acoustic parameters describe one or more acoustic properties (e.g., room impulse response, a reverberation time, a reverberation level, etc.) of the local area. The audio system 550 may provide information describing at least a portion of the local area from e.g., the DCA 545 and/or location information for the headset 505 from the position sensor 540. The audio system 550 may generate one or more sound filters using one or more of the acoustic parameters received from the mapping server 525, and use the sound filters to provide audio content to the user.

The audio system 550 is configured to reduce feedback and mitigate entrainment in audio content presented to the user. The audio system 550 utilizes adaptive feedback cancellation processes to reduce feedback. The audio system 550 processes reference signals in a hybrid of the time domain and the frequency domain to achieve rapid convergence with decreased entrainment. The audio system 550 uses a state space algorithm to generate adaptive filters in each frequency band.

The I/O interface 510 is a device that allows a user to send action requests and receive responses from the console 515. An action request is a request to perform a particular action. For example, an action request may be an instruction to start or end capture of image or video data, or an instruction to perform a particular action within an application. The I/O interface 510 may include one or more input devices. Example input devices include: a keyboard, a mouse, a game controller, or any other suitable device for receiving action requests and communicating the action requests to the console 515. An action request received by the I/O interface 510 is communicated to the console 515, which performs an action corresponding to the action request. In some embodiments, the I/O interface 510 includes an IMU that captures calibration data indicating an estimated position of the I/O interface 510 relative to an initial position of the I/O interface 510. In some embodiments, the I/O interface 510 may provide haptic feedback to the user in accordance with instructions received from the console 515. For example, haptic feedback is provided when an action request is received, or the console 515 communicates instructions to the I/O interface 510 causing the I/O interface 510 to generate haptic feedback when the console 515 performs an action.

The console 515 provides content to the headset 505 for processing in accordance with information received from one or more of: the DCA 545, the headset 505, and the I/O interface 510. In the example shown in FIG. 5, the console 515 includes an application store 555, a tracking module 560, and an engine 565. Some embodiments of the console 515 have different modules or components than those described in conjunction with FIG. 5. Similarly, the functions further described below may be distributed among components of the console 515 in a different manner than described in conjunction with FIG. 5. In some embodiments, the functionality discussed herein with respect to the console 515 may be implemented in the headset 505, or a remote system.

The application store 555 stores one or more applications for execution by the console 515. An application is a group of instructions, that when executed by a processor, generates content for presentation to the user. Content generated by an application may be in response to inputs received from the user via movement of the headset 505 or the I/O interface 510. Examples of applications include: gaming applications, conferencing applications, video playback applications, or other suitable applications.

The tracking module 560 tracks movements of the headset 505 or of the I/O interface 510 using information from the DCA 545, the one or more position sensors 540, or some combination thereof. For example, the tracking module 560 determines a position of a reference point of the headset 505 in a mapping of a local area based on information from the headset 505. The tracking module 560 may also determine positions of an object or virtual object. Additionally, in some embodiments, the tracking module 560 may use portions of data indicating a position of the headset 505 from the position sensor 540 as well as representations of the local area from the DCA 545 to predict a future location of the headset 505. The tracking module 560 provides the estimated or predicted future position of the headset 505 or the I/O interface 510 to the engine 565.

The engine 565 executes applications and receives position information, acceleration information, velocity information, predicted future positions, or some combination thereof, of the headset 505 from the tracking module 560. Based on the received information, the engine 565 determines content to provide to the headset 505 for presentation to the user. For example, if the received information indicates that the user has looked to the left, the engine 565 generates content for the headset 505 that mirrors the user's movement in a virtual local area or in a local area augmenting the local area with additional content. Additionally, the engine 565 performs an action within an application executing on the console 515 in response to an action request received from the I/O interface 510 and provides feedback to the user that the action was performed. The provided feedback may be visual or audible feedback via the headset 505 or haptic feedback via the I/O interface 510.

The network 520 couples the headset 505 and/or the console 515 to the mapping server 525. The network 520 may include any combination of local area and/or wide area networks using both wireless and/or wired communication systems. For example, the network 520 may include the Internet, as well as mobile telephone networks. In one embodiment, the network 520 uses standard communications technologies and/or protocols. Hence, the network 520 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 520 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 520 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 525 may include a database that stores a virtual model describing a plurality of spaces, wherein one location in the virtual model corresponds to a current configuration of a local area of the headset 505. The mapping server 525 receives, from the headset 505 via the network 520, information describing at least a portion of the local area and/or location information for the local area. The user may adjust privacy settings to allow or prevent the headset 505 from transmitting information to the mapping server 525. The mapping server 525 determines, based on the received information and/or location information, a location in the virtual model that is associated with the local area of the headset 505. The mapping server 525 determines (e.g., retrieves) one or more acoustic parameters associated with the local area, based in part on the determined location in the virtual model and any acoustic parameters associated with the determined location. The mapping server 525 may transmit the location of the local area and any values of acoustic parameters associated with the local area to the headset 505.

One or more components of system 500 may contain a privacy module that stores one or more privacy settings for user data elements. The user data elements describe the user or the headset 505. For example, the user data elements may describe a physical characteristic of the user, an action performed by the user, a location of the user of the headset 505, a location of the headset 505, an HRTF for the user, etc. Privacy settings (or "access settings") for a user data element may be stored in any suitable manner, such as, for example, in association with the user data element, in an index on an authorization server, in another suitable manner, or any suitable combination thereof.

A privacy setting for a user data element specifies how the user data element (or particular information associated with the user data element) can be accessed, stored, or otherwise used (e.g., viewed, shared, modified, copied, executed, surfaced, or identified). In some embodiments, the privacy settings for a user data element may specify a "blocked list" of entities that may not access certain information associated with the user data element. The privacy settings associated with the user data element may specify any suitable granularity of permitted access or denial of access. For example, some entities may have permission to see that a specific user data element exists, some entities may have permission to view the content of the specific user data element, and some entities may have permission to modify the specific user data element. The privacy settings may allow the user to allow other entities to access or store user data elements for a finite period of time.

The privacy settings may allow a user to specify one or more geographic locations from which user data elements can be accessed. Access or denial of access to the user data elements may depend on the geographic location of an entity who is attempting to access the user data elements. For example, the user may allow access to a user data element and specify that the user data element is accessible to an entity only while the user is in a particular location. If the user leaves the particular location, the user data element may no longer be accessible to the entity. As another example, the user may specify that a user data element is accessible only to entities within a threshold distance from the user, such as another user of a headset within the same local area as the user. If the user subsequently changes location, the entity with access to the user data element may lose access, while a new group of entities may gain access as they come within the threshold distance of the user.

The system 500 may include one or more authorization/privacy servers for enforcing privacy settings. A request from an entity for a particular user data element may identify the entity associated with the request and the user data element may be sent only to the entity if the authorization server determines that the entity is authorized to access the user data element based on the privacy settings associated with the user data element. If the requesting entity is not authorized to access the user data element, the authorization server may prevent the requested user data element from being retrieved or may prevent the requested user data element from being sent to the entity. Although this disclosure describes enforcing privacy settings in a particular manner, this disclosure contemplates enforcing privacy settings in any suitable manner.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. An audio system comprising:

a reference microphone configured to receive a reference audio signal;

a speaker configured to emit sound based on a speaker signal;

an error microphone configured to receive the sound emitted by the speaker and generate an error signal;

an audio controller configured to:

generate, based on the reference audio signal received by the reference microphone, a reference signal;

reduce feedback in the speaker signal provided to the speaker by feedforward processing the reference signal;

mitigate entrainment in the speaker signal by processing the error signal and the speaker signal in a frequency domain using state space filtering, wherein processing the error signal and the speaker signal comprises separating the error signal and the speaker signal into a plurality of frequency bands;

update the error signal by subtracting, based on the state space filtering, a feedback cancelation signal generated by the audio controller from an updated reference signal outputted by the reference microphone; and generate an updated speaker signal by feedforward processing the updated error signal.

2. The audio system of claim 1, wherein the mitigating entrainment further comprises executing a linear prediction algorithm on the error signal.

3. The audio system of claim 2, wherein the controller is further configured to whiten the speaker signal using whitening coefficients generated by the linear prediction algorithm.

4. The audio system of claim 1, wherein the controller is further configured to generate an adaptive filter for each of the plurality of frequency bands by executing a state space algorithm on the error signal and the speaker signal in each of the plurality of frequency bands.

5. The audio system of claim 4, wherein the controller is further configured to apply the adaptive filters to the speaker signal to generate the feedback cancelation signal.

6. The audio system of claim 5, wherein the adaptive filters are applied to the speaker signal in a time domain.

7. The audio system of claim 1, wherein the audio controller comprises:

a slow adapting adaptive feedback cancelation module configured to cancel feedback during steady-state operation; and a fast adapting adaptive feedback cancelation module configured to cancel feedback in response to a path change.

8. The audio system of claim 1, wherein the audio controller is further configured to:

estimate a mean secondary path between the speaker and the error microphone; and generate a closed loop response based on the estimated mean secondary path.

9. A method comprising:

generating, based on a reference audio signal received by a reference microphone, a reference signal;

generating, by an error microphone, an error signal based on sound emitted by a speaker, the sound emitted according to a speaker signal;

reducing feedback in the speaker signal by feedforward processing the reference signal;

mitigating entrainment in the speaker signal by processing the error signal and the speaker signal in a frequency domain using state space filtering, wherein processing the error signal and the speaker signal comprises separating the error signal and the speaker signal into a plurality of frequency bands;

updating the error signal by subtracting, based on the state space filtering, a feedback cancelation signal generated by an audio controller from an updated reference signal outputted by the reference microphone; and generating an updated speaker signal by feedforward processing the updated error signal.

10. The method of claim 9, wherein the mitigating entrainment further comprises executing a linear prediction algorithm on the error signal.

11. The method of claim 10, further comprising whitening the speaker signal using whitening coefficients generated by the linear prediction algorithm.

12. The method of claim 9, further comprising generating an adaptive filter for each of the plurality of frequency bands by executing a state space algorithm on the error signal and the speaker signal in each of the plurality of frequency bands.

13. A non-transitory computer-readable storage medium comprising stored program code that, when executed by one or more processors of an audio system, causes the audio system to:

generate, based on a reference audio signal received by a reference microphone, a reference signal;

generating, by an error microphone, an error signal based on sound emitted by a speaker, the sound emitted according to a speaker signal;

reduce feedback in the speaker signal provided to the speaker by feedforward processing the reference signal;

mitigate entrainment in the speaker signal by processing the error signal and the speaker signal in a frequency domain using state space filtering, wherein processing the error signal and the speaker signal comprises separating the error signal and the speaker signal into a plurality of frequency bands;

update the error signal by subtracting, based on the state space filtering, a feedback cancelation signal generated by an audio controller of the audio system from an updated reference signal outputted by the reference microphone; and generate an updated speaker signal by feedforward processing the updated error signal.

14. The non-transitory computer-readable storage medium of claim 13, wherein the mitigating entrainment further comprises executing a linear prediction algorithm on the error signal.

15. The non-transitory computer-readable storage medium of claim 14, wherein the program code further causes the audio system to whiten the speaker signal using whitening coefficients generated by the linear prediction algorithm.

16. The non-transitory computer-readable storage medium of claim 13, wherein the program code further causes the audio system to generate an adaptive filter for each of the plurality of frequency bands by executing a state space algorithm on the error signal and the speaker signal in each of the plurality of frequency bands.

17. The non-transitory computer-readable storage medium of claim 16, wherein the program code further causes the audio system to apply the adaptive filters to the speaker signal to generate the feedback cancelation signal.

* * * * *